US006920666B1

(12) United States Patent
Chen

(10) Patent No.: US 6,920,666 B1
(45) Date of Patent: Jul. 26, 2005

(54) CONTROL MECHANISM OF A PULL ROD

(76) Inventor: Shou Mao Chen, No. 344, Sec. 1, Chung Shan Road, Ta Cha Township, Taichung Hsien (TW)

( * ) Notice: Subject to any disclaimer, the term of this patent is extended or adjusted under 35 U.S.C. 154(b) by 0 days.

(21) Appl. No.: 10/704,952

(22) Filed: Nov. 12, 2003

(51) Int. Cl.[7] ..... A45C 7/00; B25G 1/04

(52) U.S. Cl. ..... 16/113.1; 16/405; 16/429; 16/114.1; 190/115; 190/18 A; 280/47.315

(58) Field of Search ..... 16/113.1, 405, 16/429, 114.1; 403/109.1, 109.2, 109.3, 109.8; 280/655, 655.1, 47.371, 47.315; 190/18 A, 190/115

(56) References Cited

U.S. PATENT DOCUMENTS 4,256,320 A * 3/1981 Hager ..... 280/37
5,581,846 A * 12/1996 Wang ..... 16/113.1
5,875,520 A * 3/1999 Chang ..... 16/405
6,061,871 A * 5/2000 Wang ..... 16/113.1
6,081,967 A * 7/2000 Chang ..... 16/113.1
6,122,800 A * 9/2000 Cheng ..... 16/113.1
6,148,477 A * 11/2000 Cheng ..... 16/113.1
6,226,834 B1 * 5/2001 Lu ..... 16/113.1
6,508,344 B1 * 1/2003 Lu ..... 190/115
6,564,426 B1 * 5/2003 Wang ..... 16/113.1
6,668,423 B1 * 12/2003 Chen ..... 16/113.1

FOREIGN PATENT DOCUMENTS

JP 11075925 A * 3/1999 ..... A45C 13/26

* cited by examiner

*Primary Examiner*—Chuck Y. Mah
(74) *Attorney, Agent, or Firm*—Harrison & Egbert

(57) ABSTRACT

A pull rod structure includes a pull rod and a handle fastened to a top end of the pull rod. The handle is formed of a hand grip and two control arms, each being provided therein with a control mechanism having a first activation button or a second activation button. The first activation button is pivoted with one end of the hand grip of the handle, whereas the second activation button is pivoted with the other end of the hand grip of the handle. These two activation buttons are so located on the hand grip that they are within an easy access of the thumb of a hand holding the hand grip, and that they are prevented from being activated unintentionally by the palm or fingers of the hand.

2 Claims, 7 Drawing Sheets

CONTROL MECHANISM OF A PULL ROD

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to the handle of a pull rod, and more particularly to a control mechanism which is located in the handle for controlling the pull rod.

BACKGROUND OF THE INVENTION

The luggage or the like is generally provided with an adjustable pull rod to facilitate the moving of the luggage or the like on a surface. The pull rod is provided at the outer end with a handle which is in turn provided with a hand grip and an activation button. The activation button is used to activate the adjustment mechanism of the pull rod and is located at the center of the hand grip of the handle. As a result, the activation button is prone to an unintentional activation by the hand holding the hand grip of the handle.

BRIEF SUMMARY OF THE INVENTION

The primary objective of the present invention is to provide a pull rod control mechanism which can be activated by either one of two activation buttons mounted at two opposite ends of the hand grip of a handle. The two activation buttons can be easily reached by the thumb of a hand holding the hand grip. Meanwhile, these two activation buttons are so located that they steer clear of the palm of a hand, thereby preventing an unintentional activation of the activation button.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
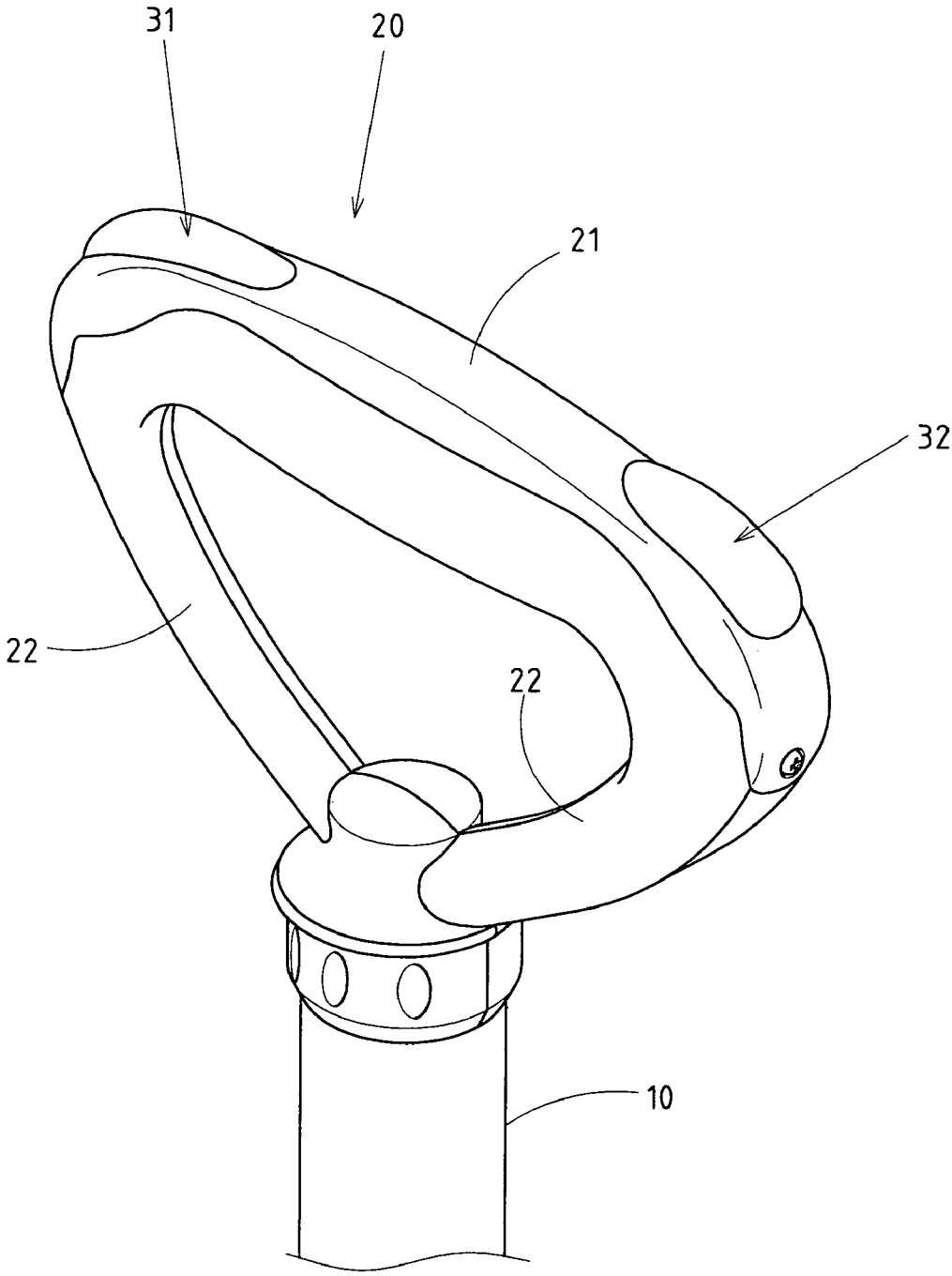
FIG. 1 shows a perspective view of the preferred embodiment of the present invention.
Figure 2:
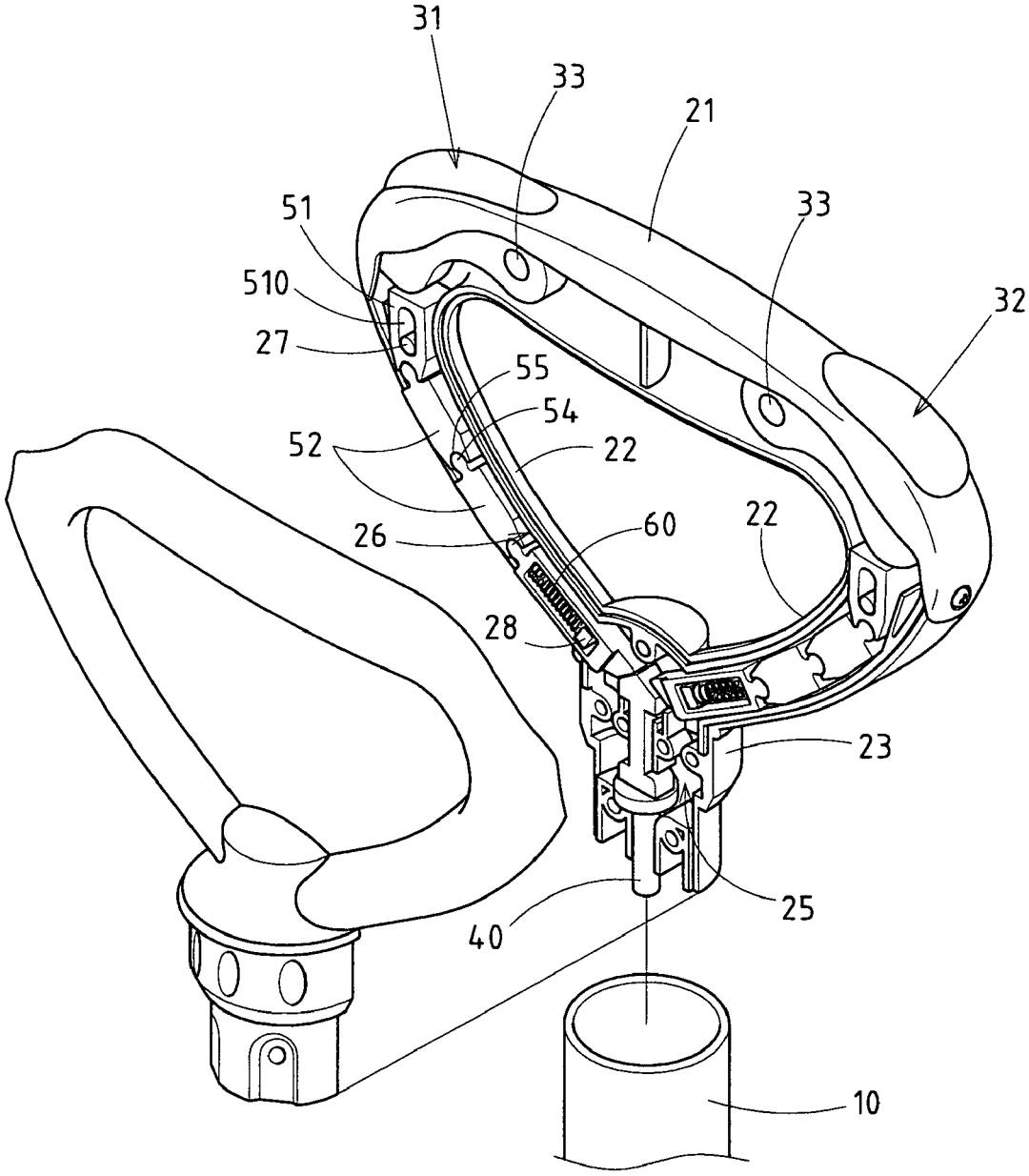
FIG. 2 shows a schematic view of a control mechanism of the preferred embodiment of the present invention.
Figure 3:
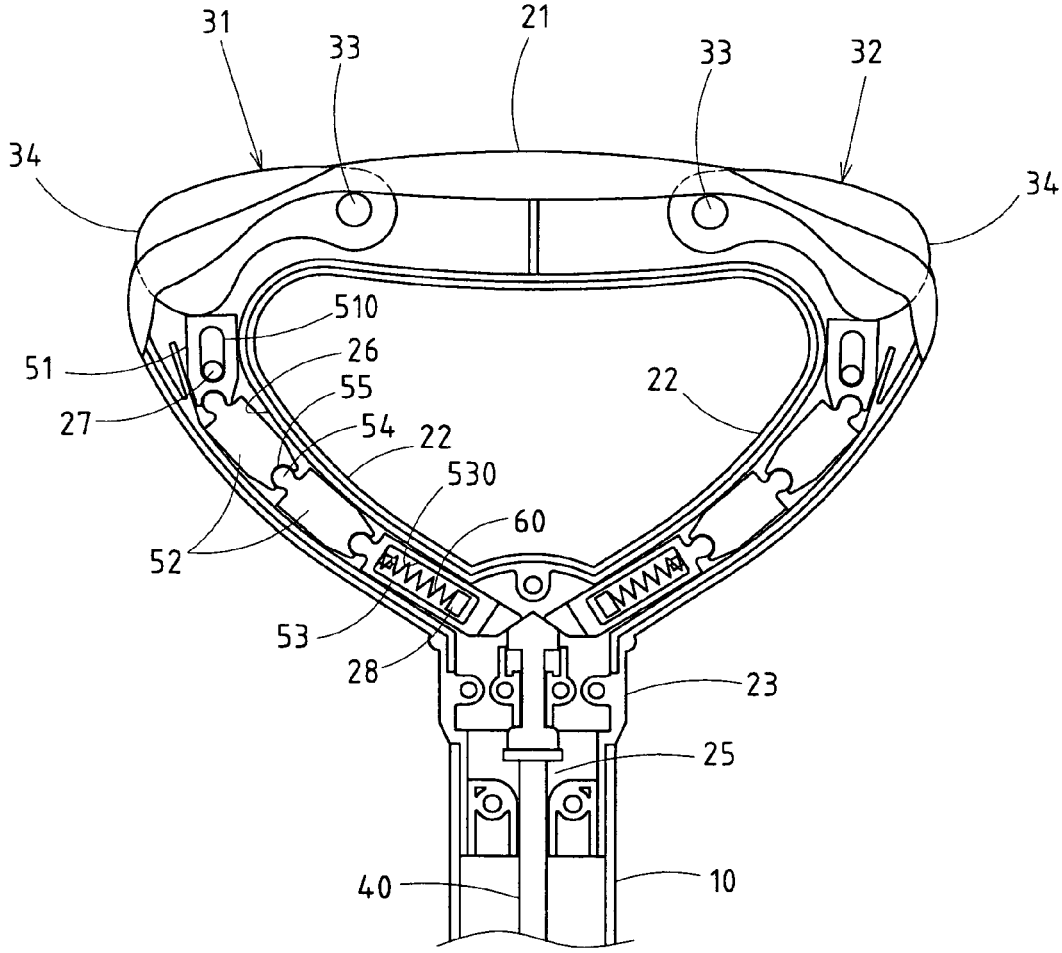
FIG. 3 shows a front view of the control mechanism of the preferred embodiment of the present invention.

As shown in FIGS. 1–3, a control mechanism embodied in the present invention is mounted in a handle 20 for controlling a pull rod 10 which is fastened to luggage (not shown in the drawings). The pull rod 10 is used to facilitate the moving of the luggage on a surface with a hand holding a hand grip 21 of the handle 20 which is fastened to a top end of the pull rod 10. In addition to the hand grip 21, the handle 20 is provided with two arms 22 extending respectively from two opposite ends of the hand grip 21. The handle 20 is further provided with a fastening portion 23, which is fastened to the top end of the pull rod 10. The free end of the two arms 22 is joined with the fastening portion 23.

The control mechanism of the present invention comprises two identical sets of mechanisms, which are respectively disposed in the interior of the two arms 22 of the handle 20. The first control mechanism set is formed of a first activation button 31, a top link block 51, a bottom link block 53, and a plurality of intermediate link blocks 52 located between the top link block 51 and the bottom link block 53. The link blocks 51, 52, and 53 are located in a receiving slot 26 of the interior of the arm 22. The top link block 51 is provided with a locating slot 510, whereas the receiving slot 26 of the arm 22 is provided with a locating projection 27 which is received in the locating slot 510 of the top link block 51. The link blocks 51, 52 and 53 are joined together end to end. For example, the two intermediate link blocks 52 are joined together end to end by a tongue 54 and a groove 55, as shown in FIGS. 2 and 3. The top link block 51 has a top end, which comes in contact with an action end 34 of the first activation button 31 which is fastened at a pivoting end 33 thereof with one end of the hand grip 21 of the handle 20. The bottom link block 53 is provided with a locating slot 530 for locating a spring 60 which is received in the locating slot 530 such that one end of the spring 60 urges a blind end of the locating slot 530, and that other end is fixed at a fixation mount 28 of the receiving slot 26 of the interior of the arm 22. The spring 60 is used to provide the control mechanism with a recovery force. The bottom link block 53 has a bottom end, which comes in contact with a top end of an actuation rod 40 which is located in a locating slot 25 of the fastening portion 23 of the handle 20.

The second control mechanism set is basically similar in construction to the first control mechanism set described above, except that the former comprises a second activation button 32 which is fastened at a pivoting end 33 on the other end of the hand grip 21 of the handle 20 such that an action end 34 of the button 32 comes in contact with the top link block 51.

Figure 4:
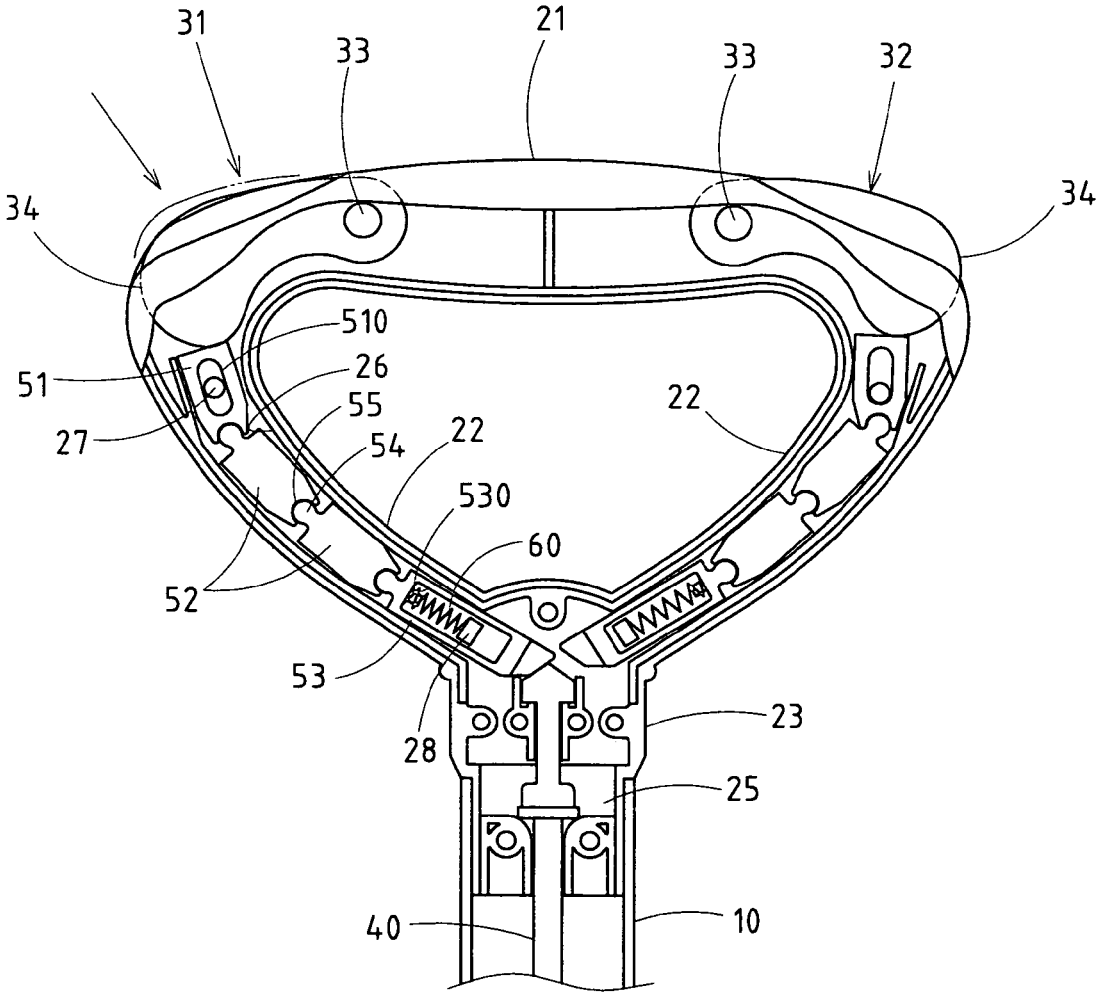
FIG. 4 shows a schematic view of the control mechanism of the preferred embodiment of the present invention in action.
Figure 5:
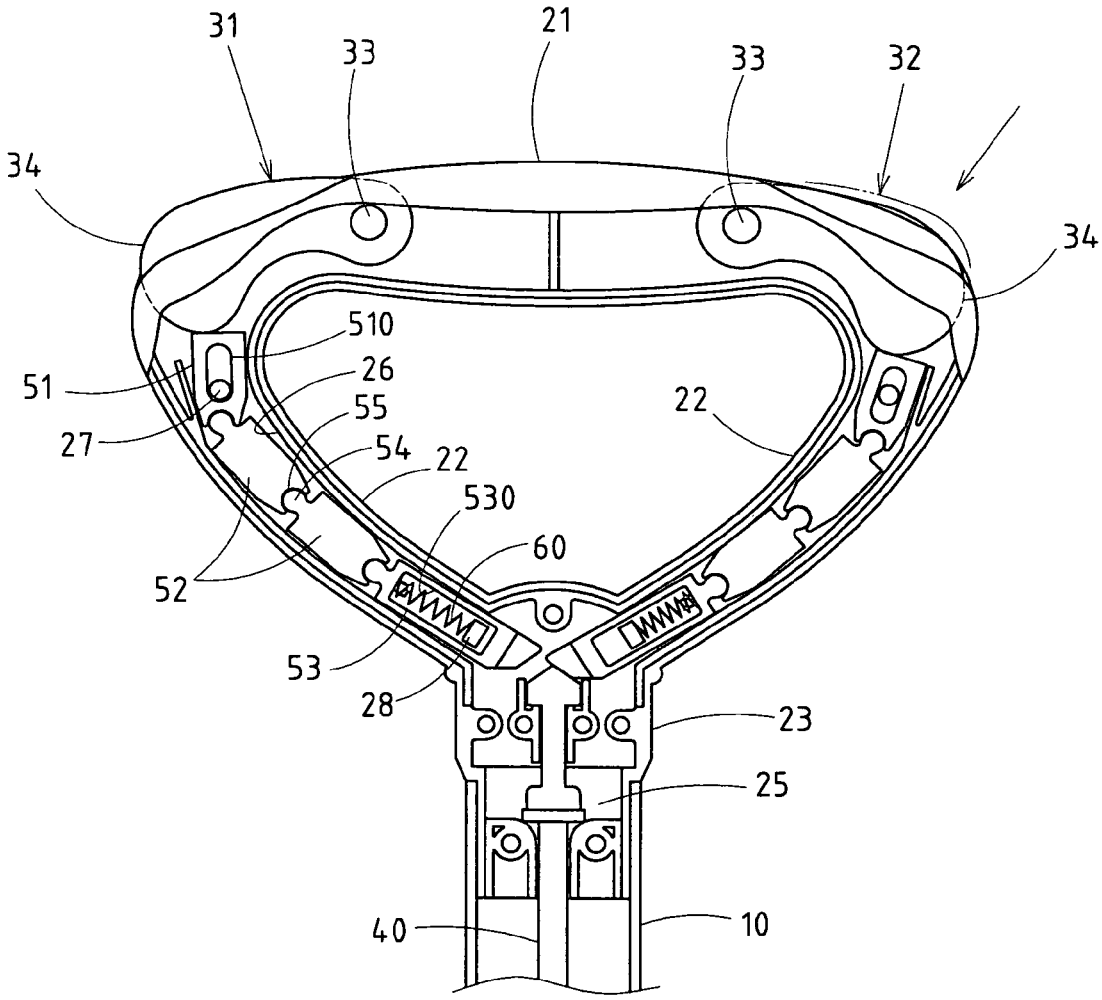
FIG. 5 shows another schematic view of the control mechanism of the preferred embodiment of the present invention in action.

As illustrated in FIGS. 4 and 5, the actuation rod 40 is activated to release the pull rod 10 when the first activation button 31 or second activation button 32 is exerted on by an external force. As soon as the first activation button 31 or second activation button 32 is relieved of the external force, the first activation bottom 31 or second activation button 32 is caused by the recovery force of the spring 60 to return to its original position.

Figure 6:
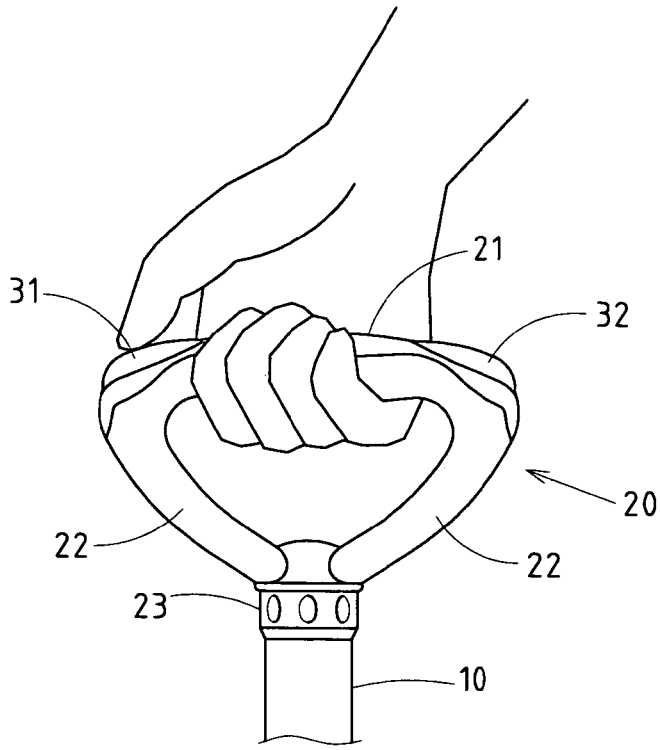
FIG. 6 shows a schematic view of the preferred embodiment of the present invention in use.
Figure 7:
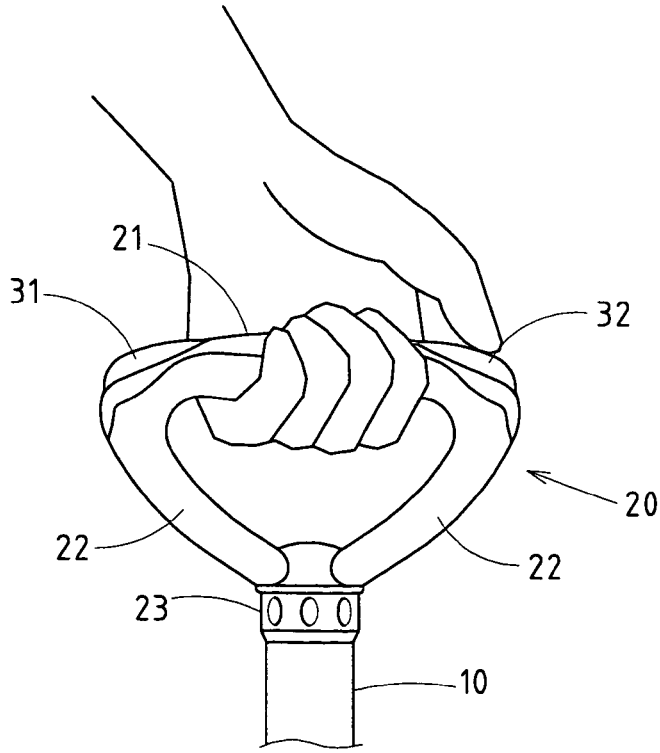
FIG. 7 shows another schematic view of the preferred embodiment of the present invention in use.

As illustrated in FIGS. 6 and 7, the first activation button 31 and the second activation button 32 are so located on the hand grip 21 of the handle 20 that they can be easily pressed with the thumb of a hand holding the hand grip 21. In addition, these two activation buttons 31 and 32 are so located that they steer clear of the palm and the fingers of the hand, thereby preventing the activation buttons 31 and 32 from being activated unintentionally by the palm or the fingers.

Figure 8:
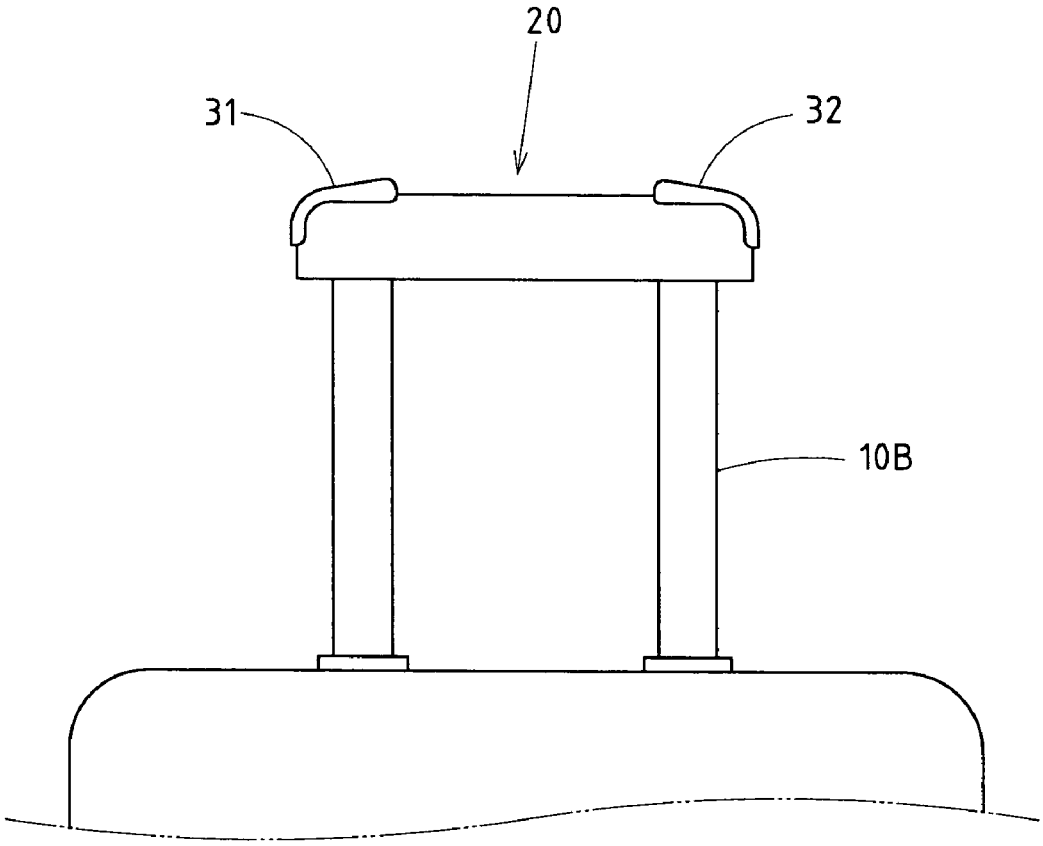
FIG. 8 shows a schematic view of the present invention in conjunction with a pull rod structure comprising two pull rods.

As shown in FIG. 8, the present invention is applicable to a pull rod structure comprising two pull rod members 10B.

The embodiment of the present invention described above is merely illustrative. Accordingly, the present invention may be embodied in other specific forms without deviating from the spirit thereof. The present invention is therefore to be limited only by the scope of the following claims.

I claim:

1. A pull rod structure comprising:

a pull rod;

a handle comprised of a hand grip, a first arm extending from a first end of said hand grip, a second arm extending from a second end of said hand grip, and a fastening portion extending jointly from a free end of said first arm and said second arm, said fastening portion being fastened to a top end of said pull rod;

a first control mechanism located in a hollow interior of said first arm of said handle for controlling said pull rod; and a second control mechanism located in a hollow interior of said second arm of said handle for controlling said pull rod;

wherein said first control mechanism comprises:

a first activation button pivoted to said first end of said hand grip;

a top link block located in said hollow interior of said first arm of said handle such that a top end of said top link block comes in contact with said first activation button;

a bottom link block located in said hollow interior of said first arm of said handle such that a bottom end of said bottom link block comes in contact with an actuation rod located in said fastening portion of said handle whereby said bottom link block is provided with a locating slot for locating a spring serving to provide said bottom link block with a recovery force; and at least one intermediate link block located in said hollow interior of said first arm of said handle such that a top end of said intermediate link block is joined with a bottom end of said top link block, and that a bottom end of said intermediate link block is joined with a top end of said bottom link block;

wherein said second control mechanism comprises:

a second activation button pivoted to said second end of said hand grip;

a top link block located in said hollow interior of said second arm of said handle such that a top end of said top link block comes in contact with said second activation button;

a bottom link block located in said hollow interior of said second arm of said handle such that a bottom end of said bottom link block comes in contact with said actuation rod located in said fastening portion of said handle whereby said bottom link rod is provided with a locating slot for locating a spring serving to provide said bottom link block with a recovery force; and at least one intermediate link block located in said hollow interior of said second arm of said handle such that a top end of said intermediate link block is joined with a bottom end of said top link block, and that a bottom end of said intermediate link block is joined with a top end of said bottom link block.

2. The pull rod structure as defined in claim 1, wherein said top link block, said intermediate block, and said bottom link block of said first control mechanism and said second control mechanism are joined together end to end by a tongue-and-groove joint.

* * * * *